US009321559B2

(12) United States Patent
Futase

(10) Patent No.: US 9,321,559 B2
(45) Date of Patent: Apr. 26, 2016

(54) FLEXIBLE PACKAGING BAG

(75) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 60 days.

(21) Appl. No.: 13/984,360

(22) PCT Filed: Feb. 10, 2012

(86) PCT No.: PCT/JP2012/053040

§ 371 (c)(1),
(2), (4) Date: Aug. 8, 2013

(87) PCT Pub. No.: WO2012/111538

PCT Pub. Date: Aug. 23, 2012

(65) Prior Publication Data

US 2013/0315508 A1 Nov. 28, 2013

(30) Foreign Application Priority Data

Feb. 14, 2011 (JP) ..... 2011-028070

(51) Int. Cl.
*B65D 33/24* (2006.01)
*B65D 75/58* (2006.01)
*B65D 75/00* (2006.01)

(52) U.S. Cl.
CPC ..... *B65D 33/24* (2013.01); *B65D 75/5811* (2013.01); *B65D 75/5866* (2013.01); *B65D 75/008* (2013.01)

(58) Field of Classification Search
CPC .... B65D 31/14; B65D 35/46; B65D 47/2018; B65D 49/02; B65D 33/24; B65D 75/008; B65D 75/5811; B65D 75/5866
USPC ..... 383/43, 44, 47, 104, 906; 222/107, 572, 222/494, 212–213
See application file for complete search history.

(56) References Cited

U.S. PATENT DOCUMENTS 3,184,121 A * 5/1965 Volckening ..... 222/213
4,830,205 A * 5/1989 Hammond et al. ..... 215/11.3

(Continued)

FOREIGN PATENT DOCUMENTS

CN 1203557 12/1998
JP 2000-500721 1/2000

(Continued)

OTHER PUBLICATIONS

Chinese Office action having mail date of May 29, 2014.

(Continued)

*Primary Examiner* — Nathan J Newhouse
*Assistant Examiner* — Peter Helvey
(74) *Attorney, Agent, or Firm* — Greenblum & Bernstein, P.L.C.

(57) ABSTRACT

A flexible package bag is equipped with a film-shape non-return nozzle by which a pouring amount of a liquid packed material can be stabilized by rectifying a pouring flow of the liquid packed material. The pouring performance and breaking resistance of the bag can be improved by reinforcing the film-shaped non-return nozzle. A flexible package bag is formed by fusion-joining a base end portion of a film-shaped non-return nozzle having an outer non-return function of preventing penetration of ambient air into the bag to inner surfaces of a side portion of a main package bag body composed of plastic laminate films and projecting therefrom. A seal section for rectification/reinforcement formed by fusing two opposed plastic laminate films is disposed at a position near to the main package bag body including a lower portion of a fused section to the base end portion of the film shaped non-return nozzle.

8 Claims, 5 Drawing Sheets

(56) References Cited

U.S. PATENT DOCUMENTS

| | | | | | |
|---|---|---|---|---|---|
| 4,974,732 | A * | 12/1990 | Sullivan | B65D 75/008 | 206/484 |
| 5,018,646 | A * | 5/1991 | Billman | B65D 75/5822 | 222/107 |
| 5,195,658 | A | 3/1993 | Hoshino | | |
| 5,378,065 | A | 1/1995 | Tobolka | | |
| 5,761,884 | A | 6/1998 | Tobolka | | |
| 5,800,062 | A | 9/1998 | Tobolka | | |
| 5,863,131 | A * | 1/1999 | Nakamura | 383/89 | |
| 6,164,042 | A | 12/2000 | Tobolka | | |
| 2002/0141664 | A1 * | 10/2002 | Matsuda et al. | 383/40 | |
| 2003/0146247 | A1 * | 8/2003 | Oren et al. | 222/494 | |
| 2008/0264970 | A1 * | 10/2008 | Kasai | 222/105 | |
| 2010/0119783 | A1 * | 5/2010 | Futase | 428/192 | |
| 2010/0209025 | A1 * | 8/2010 | Futase | 383/113 | |
| 2012/0114269 | A1 | 5/2012 | Futase et al. | | |

FOREIGN PATENT DOCUMENTS

| | | |
|---|---|---|
| JP | 2005-15029 | 1/2005 |
| JP | 2005-52596 | 3/2005 |
| JP | 2005-59958 | 3/2005 |
| JP | 2010-095272 | 4/2010 |
| JP | 2010-260614 | 11/2010 |
| WO | 96/11854 | 4/1996 |
| WO | 2010/150911 | 12/2010 |
| WO | 2011/016573 | 2/2011 |

OTHER PUBLICATIONS

European Search Report for EP Application No. 12747231 mailed Aug. 4, 2015.

* cited by examiner

FLEXIBLE PACKAGING BAG

TECHNICAL FIELD

The present invention relates to a flexible package bag formed by projectingly fitting at a side portion of a main package bag body a film-shaped non-return nozzle (a liquid pouring nozzle) composed of a pair of front and rear flat flexible plastic laminate films and having a self-sealing non-return function of automatically preventing penetration of ambient air into an inside of the bag.

BACKGROUND ART

As the film-shaped non-return nozzle composed of the flexible plastic laminate films and having a self-sealing non-return function and the flexible package bag equipped therewith have been disclosed the inventors' proposals in the following Patent Documents 1 and 2.

Patent Document 1: JP-A-2005-15029

Patent Document 2: JP-A-2005-59958

SUMMARY OF THE INVENTION

Task to be Solved by the Invention

The non-return function of the film-shaped non-return nozzle disclosed in Patent Documents 1 and 2 means a self-sealing non-return function of preventing penetration of ambient air wherein the flat and closable front and rear plastic laminate films are oppositely overlaid on each other and a pouring path formed between the plastic laminate films is closed by a liquid material always existing therein through capillary action.

The film-shaped non-return nozzle and the flexible package bag equipped therewith as disclosed in these patent documents are used as a liquid filling package structure substantially including only a liquid packed material (filled at a gasless state) by in-liquid seal-packing of a liquid material such as soy sauce and other liquid seasonings, salad oil or the like. The liquid filling package structure is characterized in that the liquid packed material does not absolutely come in contact with air in the pouring of the liquid packed material.

Since the liquid packed material airtightly packed in such a package bag does not cause chemical change such as oxidation or the like, there is a merit that the material can be kept in the original state for a long time.

The pouring of the liquid packed material filled in the package bag with such a film-shaped non-return nozzle is carried out by cutting out a given opening portion formed in the vicinity of a top end part of the film-shaped non-return nozzle (a tip side from a position of forming a tear-inducing flaw or notch) with hand and fingers and then tilting the main bag body of the package bag so as to aim an opening portion of the film-shaped non-return nozzle (pouring port) downward to thereby open the pouring port through the action of hydraulic head pressure of the liquid packed material.

However, when the liquid packed material is poured by tilting the main package bag body as mentioned above, if a large amount of the liquid packed material is contained in the package bag, there is a problem that a large amount of the liquid packed material may easily flow into the film-shaped non-return nozzle due to a high hydraulic head pressure of the liquid packed material, and hence a pouring amount is hardly controlled but also liquid dripping may be generated easily.

In the package bag equipped with such a film-shaped non-return nozzle, the main package bag body is shrunk or collapse-deformed gradually in response to the poured volume of the liquid packed material, so that as the liquid packed material in the bag is decreased, the water head pressure of the liquid packed material yields to the adhesion force between the inner surfaces of the pouring path of the non-return nozzle, and hence the pouring port cannot be opened only by tilting the main bag body. To this end, the liquid packed material is poured by pushing a trunk of the main package bag body with fingers. Even in this case, however, there are problems that it is difficult to control a pouring amount or a pouring direction and liquid dripping is easily generated.

In the conventional package bag, as shown in FIG. 1 (*a*), a liquid reserving portion 1*b* for controlling the pouring amount is disposed at a lower edge portion of the film-shaped non-return nozzle 1, especially a place adjacent to a side of a base end portion for attaching the nozzle (the side of the main package bag body), at where the flow to be poured can be temporarily reserved to prevent excessive pouring and ensure stable quantitative pouring. In this case, however, as shown by arrow in FIG. 1(*a*), a lower end side of the pouring flow of the liquid packed material flown into the film-shaped non-return nozzle 1 will run to a pouring port 1*a* through a lower end of the nozzle base end portion and a protruded portion of an upper end of a liquid reserving portion 1*b*. In such a package bag, therefore, there is no problem in a state of existing a large amount of the liquid packed material in the main bag body because the liquid packed material can flow into the whole of the pouring path 8 of the film-shaped non-return nozzle 1 and the pouring port 1*a* can be opened widely by the hydraulic pressure of the liquid material flown for pouring. However, as the amount of the liquid packed material in the main bag body is decreased, the opening portion 1*d* of the pouring port 1*a* becomes narrow, so that there is a problem that the liquid packed material is hardly poured.

Furthermore, in the package bag having the film-shaped non-return nozzle, a thin and weak plastic laminate film is used as the nozzle in order to effectively develop the self-sealing non-return function of the film-shaped non-return nozzle. Therefore, an outer peripheral sealed portion of the film-shaped non-return nozzle is weak in the seal strength and narrow as 0.5-3 mm in the seal width as compared to the main package bag body composed of thick and elastic plastic laminate film, so that there is a problem that when a great amount of the liquid packed material is flown into the nozzle due to the application of a load to the package bag or the like, the outer peripheral sealed portion of the nozzle is easily separated and broken by a tensile force due to a hydraulic pressure of the liquid packed material, and also there is a problem that the film-shaped non-return nozzle is bent from its base end portion due to weak nerve property when being exposed to a reduced-pressure atmosphere by the pouring pressure of the liquid packed material or the shrinkage of the main bag body after pouring, whereby the non-return function is deteriorated or the pouring direction cannot be controlled.

Now, the present invention is to solve the above-mentioned problems of the conventional techniques and to provide a flexible package bag equipped with a film-shape non-return nozzle wherein a pouring amount of a liquid packed material can be stabilized by rectifying a pouring flow of the liquid packed material and also the liquid packed material can be poured smoothly even if the amount of the liquid packed material in the bag is small, and further the pouring performance and breaking resistance of the bag can be improved by reinforcing the film-shaped non-return nozzle.

Solution for Task

In order to achieve the above-mentioned objects, the inventors have made various studies and have developed the present invention relating to the following summary and constructions. Namely, the present invention is a flexible package bag formed by fusion-joining a base end portion of a film-shaped non-return nozzle having an outer non-return function of preventing penetration of ambient air into the bag to inner surfaces of a side portion of a main package bag body composed of plastic laminate films and projecting therefrom, characterized in that a seal section for rectification/reinforcement formed by fusing two opposed plastic laminate films is disposed at a position near to the main package bag body including a lower portion of a fused section to the base end portion of the film shaped non-return nozzle.

In the flexible package bag of the present invention, the followings are more preferable means:

(1) the seal section for rectification/reinforcement consists of a heat-seal section with an approximately longitudinal ellipsoid formed in a zone including a fused section between a longitudinal seal section of the main package bag body side the film-shaped non-return nozzle and a base end portion of the outer peripheral sealed portion in a lower side of the film-shaped non-return nozzle;

(2) the upper end portion of the seal section for rectification/reinforcement is disposed on an approximately extended line in an inner edge direction of the outer peripheral sealed portion in the lower side arriving at a pouring port of the film-shaped non-return nozzle;

(3) the base end portion of the film-shaped non-return nozzle is fused at a low temperature by an opposed sealant layer made of a low-melting plastic film to temporarily seal inner surfaces of a pouring path;

(4) the film-shaped non-return nozzle has a wet-treated layer on an inner surface of at least one of the two plastic laminate films constituting the nozzle;

(5) the wet-treated layer is formed on a portion constituting the pouring path and in a range of 1-3mm outside from the side edge of the pouring path; and (6) a pouring port formed by tearing a tip part of the film-shaped non-return nozzle has an opening diameter (d) in a thickness direction being not more than ⅓ of a maximum opening diameter (D) ($d<\frac{1}{3}D$).

Effect of the Invention

According to the flexible package bag of the present invention, the seal section for rectification/reinforcement formed by fusing the two opposed plastic laminate films to each other is disposed at the position near to the main package bag body including a lower portion of a fused section to the base end portion of the film shaped non-return nozzle, so that the liquid packed material flown into the film-shaped non-return nozzle is dammed once by the seal section for rectification/reinforcement, and hence the rectification of the pouring flow can be attained to surely control the pouring amount of the liquid packed material and generation of liquid dripping can be suppressed. Further, the opening in a direction separating the two plastic laminate films constituting the nozzle to each other (direction to front side and rear side) is suppressed to make tensile force to the nozzle (tensile force in a thickness direction) small, whereby the separation of the outer peripheral sealed portion of the nozzle can be prevented.

Moreover, according to the present invention, since the pouring port at the tip of the non-return nozzle can be always opened largely, the effect of pouring the liquid packed material smoothly can also be expected.

According to the present invention, since the seal section for rectification/reinforcement is disposed so as to include the lower portion of the fused section between the main package bag body and the base end portion of the film-shaped non-return nozzle, the fusion-joint strength between the main package bag body and the base end portion of the film-shaped non-return nozzle can be improved by the seal section for rectification/reinforcement. Also, since the film strength in the lower part of the base end portion of the film-shaped non-return nozzle composed of the thin and week plastic laminate films can be reinforced to the same level as the film strength of the main package bag body, the film-shaped non-return nozzle is prevented from bending at its base end position, and the pouring performance can be improved.

Moreover, according to the present invention, the wet-treated layer is formed in not only the inner surface of the pouring path of the film-shaped non-return nozzle but also the portion of 1-3-mm outside from the side edge of the pouring path (the sealed part in the outer periphery of the nozzle), so that the wet treatment is subjected to the whole of the pouring path. Thereby, the adhesion force between the films is more strengthened at the boundary between the pouring path and the outer peripheral sealed portion of the nozzle as compared to the conventional one, so that air or the like can be surely prevented from penetrating from the pouring port, and the liquid packed material in the bag can be kept in an initial fresh state for a long time, while even if fusion at the boundary part between the pouring path and the outer peripheral sealed portion of the nozzle is separated, the self-sealing non-return function can be developed effectively without causing non-wet treated portion.

According to the present invention, the inner surfaces of the base end portion (inlet part) of the film-shaped non-return nozzle are temporarily sealed to each other by low-temperature fusion treatment, so that there can be provided a flexible package bag equipped with the film-shaped non-return nozzle wherein the non-return function characteristics are not obstructed even if unexpected force is applied to the nozzle portion during the handling or the like.

Furthermore, according to the present invention, the flexible package bag can be stood independently by forming a self-standing bottom portion in the lower end of the main bag body. In addition, since the main bag body is a bag sealed on three sides other than the self-standing bottom portion, its standing posture is cylindrical (reservation of filling space) at a lower part, even after the liquid material to be packed is filled into the main bag body by in-liquid seal-filling or the like, the standing posturer of the bag can maintain a flat planular form at its upper part as compared to a cylindrical form of its lower part (securement of filling space), so that the non-return function of the film-shaped non-return nozzle can be developed effectively.

BEST MODE FOR CARRYING OUT THE INVENTION

The film-shaped non-return nozzle having a self-sealing non-return function, which automatically prevents ambient air from penetrating into the bag, is formed by superimposing flexible plastic laminate films of two or three layers each consisting of a uniaxially or biaxially oriented thermoplastic base film layer and a sealant layer(s) laminated on one side or both sides thereof to each other as front and rear sides (an example of three layer structure will be described hereinafter). For example, the opposed sealant layers of the pair of two flexible plastic laminate films, or opposite sealant layers of a single flexible plastic laminate film folded in a half width are flatly fused to each other at a given width, for example, a width of 0.5-3.0 mm, preferably 1.0-2.0 mm without generating wrinkles in an outer peripheral portion other than a base end portion connected to the main bag body of the package bag and a central portion constituting a liquid pouring path through heat sealing, high frequency sealing, impulse sealing or the like so as to form substantially a wedge shape as a whole.

The term "non-return function" of the film-shaped non-return nozzle means such an outer non-return function that when the liquid packed material is poured from the package bag, penetration of air or the like into the inside of the package bag instead of the liquid packed material is prevented as described below in detail, which is different from an inner non-return function of preventing discharge of the liquid packed material from the main bag body as in a non-return nozzle disclosed in JP-A-2005-52596.

Since the film-shaped non-return nozzle does not suffer load by the liquid packed material, a thin plastic laminate film of a three layer structure such as PE20/NY15/PE20 is preferable. As the thickness becomes thinner and the nerve of the film is weak, the non-return function is better. Especially, the two front and rear plastic laminate films provide a higher non-return effect as the flattening property (flatness) becomes higher, so that a gap between the two front and rear plastic laminate films in the superimposing is required to be about 2 μm-300 μm. Also, when the non-return nozzle is formed by using PVDC as a sealant material to provide a thin and flexible three layer laminate film, for example, composed of a combination of PE15/PET12/PVDC5, the pouring port is easily opened with a small force and the pouring is easy. Furthermore, since PVDC itself is excellent in the gas barrier property and heat-sealing property, it is preferable in a point that a gas barrier layer is not necessary to be formed on the base film.

Figure 2:
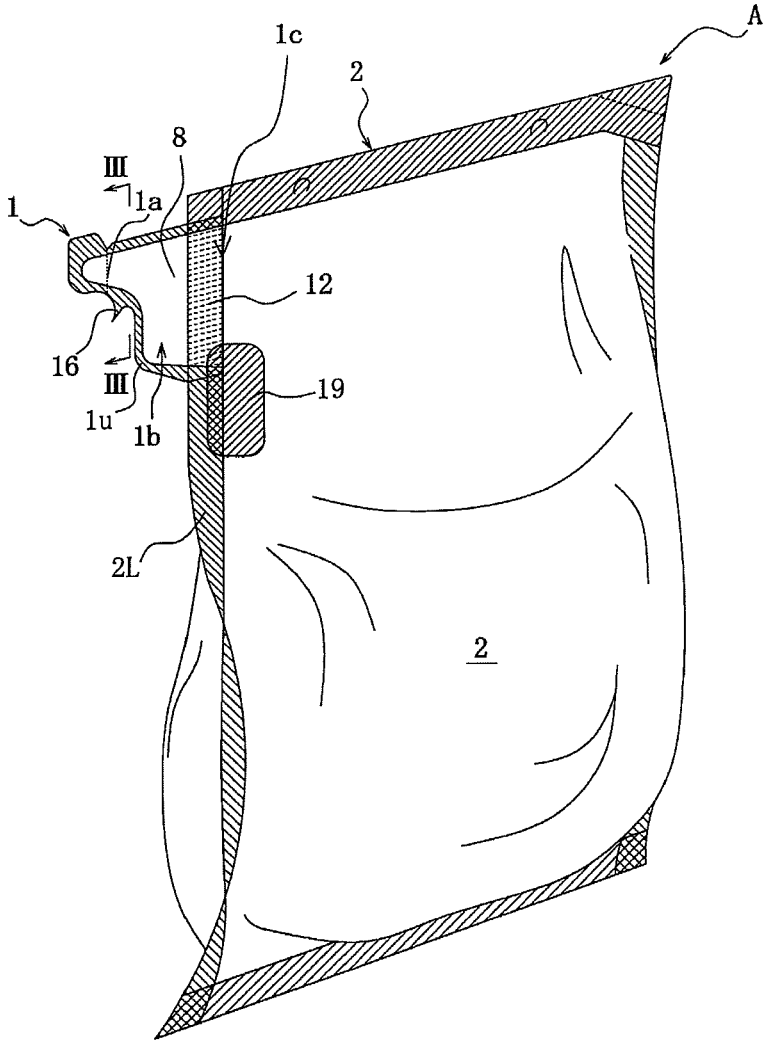
FIG. 2 is a front view showing an embodiment of the flexible package bag equipped with a film-shaped non-return nozzle according to the present invention.

Such a film-shaped non-return nozzle is fusion-joined easily, rapidly and surely at a state of protruding from the main package bag body in the base end portion thereof by fusing the sealant layer located at the outer surface of the nozzle, for example, a non-oriented olefinic resin layer such as various PE layers, PP layers, EVA layers, metallocene-catalyzed polyethylene layer or the like; or a thermoplastic resin layer such as ethylene vinyl acetate copolymer layer, ethylene ethyl acrylate copolymer layer, ionomer layer, PVDC layer, EVOH layer or the like to the sealant layer (preferably, the same kind of sealant layer) at the inner surface of the main package bag body composed of a flexible plastic laminate film (mainly two layers) through, for example, heat sealing, which is used as a flexible package bag A equipped with a film-shaped non-return nozzle as shown in FIG. 2.

Figure 3:
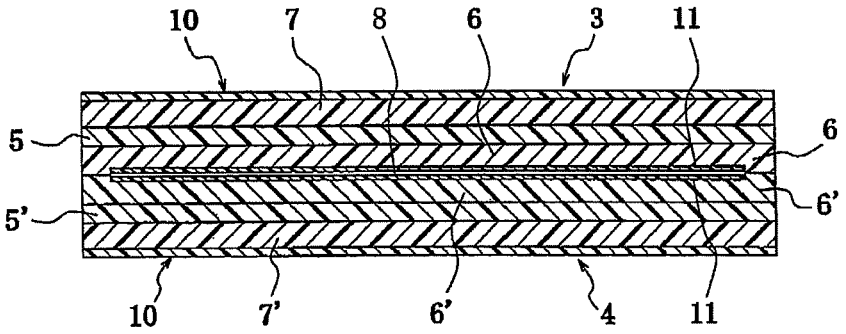
FIG. 3 is an enlarged section view taken along a line of FIG. 2.

Moreover, when each of the front and rear plastic laminate films 3, 4 fused to each other is a three layer structure of a base film layer 5, 5' longitudinally disposed in substantially a widthwise direction of the plastic laminate film and sealant layers 6, 6' and 7, 7' laminated on both surfaces of the base film layer 5, 5' as shown in FIG. 3 by an enlarged section view taken along a line III-III of FIG. 2, the film-shaped non-return nozzle 1 can be produced simply, rapidly and always surely by fusing the oppositely facing inner sealant layers 6, 6' to each other in their peripheral portions other than the base end side at a given width, for example, a width of 0.5-3 mm, preferably 1.0-2.0 mm so as to be a required shape (wedge shape) through, preferably, heat sealing. The term "substantially a widthwise direction" used herein is based on a consideration that a tearing direction and hence an extending direction of an opening edge portion of the non-return nozzle may be inclined at an angle of 0-15° with respect to the widthwise direction of the plastic laminate film likewise the aforementioned case. The film-shaped non-return nozzle is characterized to be a flat shape and can be joined always properly, surely and simply at its base end portion to the main package bag body 2 by fusing the outer sealant layer 7, 7' to the inner surface of the main package bag body 2 through, preferably, heat sealing.

On the other hand, as the film construction of the main package bag body, the base film layer located at the outer surface of the body and the sealant layer located at the inner surface of the body may be the same as in the base film layer and sealant layer of the film-shaped non-return nozzle. Also, a different middle layer may be properly interposed between the base film layer and the sealant layer in the film-shaped non-return nozzle and the main package bag body. Preferably, the sealant layer constituting the inner surface of the main bag body made of the soft plastic laminate film is made from the same resin material as in the outermost sealant layer of the non-return nozzle. Thus, the fusion-joining strength between the non-return nozzle and the main bag body can be enhanced sufficiently.

In the main package bag body, for example, the uniaxially or biaxially oriented base film layer in the two or three layer laminate film is preferably constituted with polyethylene terephthalate film layer (PET layer), nylon resin film layer (NY layer), ethylene vinyl alcohol (EVOH) or the like having a thickness of 8-30 μm, and the sealant layer is preferably constituted with a non-oriented PE layer, PP layer, EVA layer, ionomer layer, EVOH layer or the like having a thickness of 10-60 μm.

Namely, PET layer and NY layer as the base film layer are preferable since they develop an excellent vapor impermeability and a high gas barrier property, and PE layer and PP layer as the sealant layer are excellent in the heat sealing property at a relatively low temperature and are preferable for improving the sealing strength.

The pouring of the liquid packed material filled in the package bag equipped with the film-shaped non-return nozzle according to the present invention is carried out by cutting a predetermined opening portion formed in the vicinity of the top end portion of the film-shaped non-return pouring nozzle (a tip side from a position of forming a tear-inducing flaw or notch) with hand and fingers and then tilting the main bag body of the package bag so as to aim an opening portion of the film-shaped non-return nozzle (pouring port) downward.

In this case, the pouring path of the non-return nozzle made of the pair of the front and rear flexible plastic laminate films is separated toward front and rear sides to make a large space due to the fact that the adhesion through intermolecular force between film-liquid-film generated owing to the always-existing liquid material is released by the action of hydraulic head pressure of the liquid packed material or the action of pressurizing a trunk portion of the main bag body of the package bag with hand and fingers, which allows for the pouring of the liquid packed material.

Moreover, when the liquid packed material is poured through the opening portion (pouring port) of the film-shaped non-return nozzle, the main bag body made of the flexible laminate film is sequentially subjected to shrinkage or collapse deformation by an amount corresponding to the poured volume because intake of ambient air (back flowing) is not conducted because of the self-sealing non-return function of the film-shaped non-return nozzle (no penetration of air into the main bag body instead of the poured liquid material) irrespectively of the pouring of the liquid material.

That is, the predetermined amount of the liquid packed material in the package bag is poured from the bag by tilting the film-shaped non-return nozzle under the opened state thereof, and the pouring of the liquid packed material from the opening portion of the film-shaped non-return nozzle is stopped by restoring the package bag to the original standing posture. Since the inside of the pouring path in the film-shaped non-return pouring nozzle and the non-liquid portion in the main bag body are always at a wetted state due to the interposition of the liquid packed material filled in the main bag body through capillary action, the inner surfaces of the plastic laminate films in the film-shaped non-return nozzle are strongly adhered to each other at the same time of the pouring stop, and hence the opening portion formed in the tip part of the film-shaped non-return nozzle is also adhered, the penetration of ambient air into the inside of the main bag body can be blocked surely.

As seen from the above description, the liquid material is always present between the inner surfaces (pouring path) of the two plastic laminate films constituting the film-shaped non-return nozzle through the capillary action as long as the liquid material remains in the main bag body. Namely, the outer non-return function by closely adhesion of these films is automatically conducted by restoring the flexible package bag to the standing posture to release the film-shaped non-return nozzle from the action of hydraulic head pressure to thereby return the nozzle to the original production form, and further by attracting the inner surfaces of the pair of the front and rear plastic laminate films (pouring path) wetted with the liquid packed material to each other under a reduced pressure when a part of the liquid packed material in the film-shaped non-return nozzle flows back to the inside of the main bag body (self-sealing). Such an adhesion is attained more surely when the main bag body shrunk or collapsed with the pouring of the liquid packed material from the package bag acts to render the inside thereof into a reduced pressure based on the elastic restoring force inherent to the main bag body.

However, if it is intended to pour the liquid packed material by tilting the package bag at a state that a great amount of the liquid packed material exists in the package bag as mentioned above, a lot of the liquid packed materials flows into the film-shaped non-return nozzle portion due to high hydraulic head pressure of the liquid packed material regardless of slight tilting, and hence not only the pouring amount cannot be controlled but also liquid dripping easily generates, and there is a problem that the outer peripheral sealed part of the nozzle is separated easily by the hydraulic pressure of the liquid packed material. On the contrary, as the liquid packed material in the bag is decreased, the hydraulic head pressure of the liquid packed material becomes small, so that it is necessary to push the trunk portion of the main bag body with fingers to apply a pressure to the liquid packed material to thereby open the pouring port of the non-return nozzle. Also in this case, there is a problem that it is difficult to control not only the pouring amount but also the pouring direction.

Figure 1:
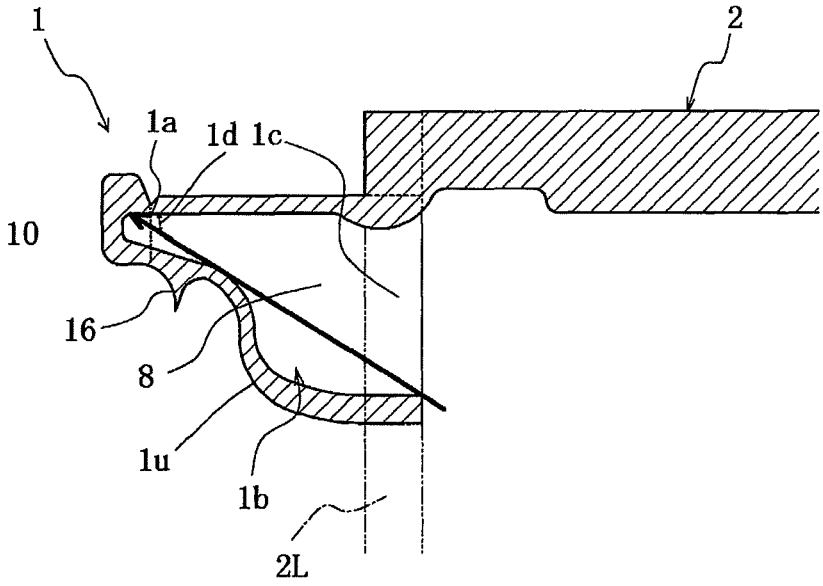
FIG. 1(*a*) is a partial enlarged view showing a pouring direction of a liquid packed material in the conventional flexible package bag and FIG. 1(*b*) is a partial enlarged view showing a pouring direction of a liquid packed material in a flexible package bag of the present invention.
Figure 1:
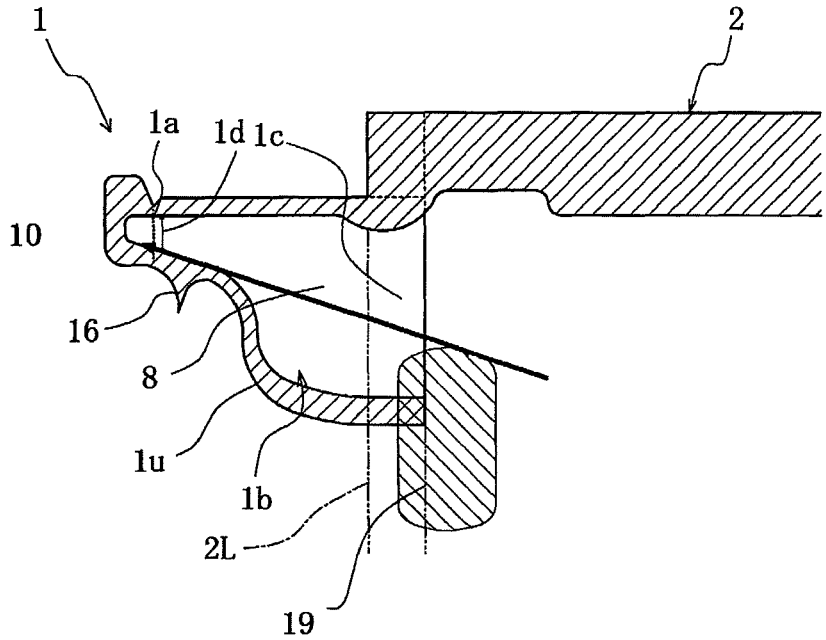

Moreover, the liquid packed material flowed into the film-shaped non-return nozzle directs toward the pouring port 1*a* through the lower end of the base end portion 1*c* of the nozzle and the protruding part at the upper end of the liquid reserving portion 1*b* shown in FIG. 1 (*a*) as mentioned above, so that there is a problem that if the liquid packed material in the bag is particularly decreased to reduce the hydraulic head pressure, it becomes difficult to largely open the pouring port 1*a* and the liquid packed material is hardly poured.

In the present invention, therefore, a seal section for rectification/reinforcement 19 formed by fusing the two front and rear plastic laminate films of the main package bag body 2 in a form of, for example, lengthwise ellipse is disposed in a zone near to the lower portion of the fused section between the main package bag body 2 and the nozzle 1 (nozzle base end portion 1*c*) as shown in FIG. 2. Once the pouring stream of the liquid packed material toward the film-shaped non-return nozzle 1 is stopped and rectified by the seal section for rectification/reinforcement 19, the liquid packed material after the rectification is then flown into the film-shaped non-return nozzle 1, so that the pouring amount of the liquid packed material can be easily controlled and also the generation of liquid dripping can be controlled effectively. Moreover, the opening of the two front and rear plastic laminate films constituting the nozzle into a direction of separating from each other (direction of expanding by the inflow of the liquid packed material) is suppressed by the seal section for rectification/reinforcement 19, the tensile force to the nozzle becomes small, and thus there is no fear that the outer peripheral sealed portion of the non-return nozzle 1 is peeled off to destroy the bag even if a large amount of the liquid packed material flows into the film-shaped non-return nozzle 1.

In the present invention, as shown in FIG. 2, the seal section for rectification/reinforcement 19 is formed by fusing the opposed plastic laminate films to each other through heat sealing so as to include a fused section between a longitudinal sealed portion 2L of the main package bag body 2 side the nozzle and a nozzle base end portion of the outer peripheral sealed portion 1*u* in the lower side of the film-shaped non-return nozzle 1, so that there are effects that joint between the main package bag body and the film-shaped non-return nozzle can be strengthened especially at a lower end position of the nozzle base end portion being apt to concentrate the hydraulic pressure of the liquid packed material and peel off the fusion, and that the film strength of the lower part of the base end portion of the film-shaped non-return nozzle made from the thin and feeble plastic laminate films can be improved to the same level as the film strength of the main package bag body and hence the bending of the film-shaped non-return nozzle or the like can be suppressed to improve the pouring performance.

In the conventional technique, as previously mentioned, the liquid packed material flown into the film-shaped non-return nozzle moves to the pouring port 1*a* through the lower end of the nozzle base end portion 1*c* and the protruding part at the upper end of the liquid reserving portion 1*b* as shown by arrow in FIG. 1(*a*), the actual opening part 1*d* becomes smaller than the pouring port 1*a*. When the amount of the liquid packed material in the bag is large, a large amount of the liquid packed material flows into the film-shaped non-return nozzle, and hence the pouring port 1*a* can be largely opened by its hydraulic head pressure. However, there is a problem that as the amount of the liquid packed material in the bag becomes small, the hydraulic head pressure becomes low to narrow the opening portion 1*d* of the pouring port 1*a* and hence the liquid packed material cannot be poured.

In this regard, according to the present invention, the lower side of the pouring stream of the liquid packed material moves through the upper corner part of the seal section for rectification/reinforcement 19 and the protruding part at the upper end of the liquid reserving portion 1*b* toward the pouring port 1*a* as shown by arrow in FIG. 1(*b*), so that the opening portion 1*d* of the pouring port 1*a* becomes larger than the conventional one, and the liquid packed material can always be poured smoothly.

Moreover, the size of the seal section for rectification/reinforcement 19 may be a size including the fused section between the longitudinal sealed portion 2L of the main package bag body and the nozzle base end part of the outer peripheral sealed portion 1*u* at the lower side of the film-shaped non-return nozzle 1, and is preferable to be properly selected by the volume of the package bag, the size of the film-shaped non-return nozzle and the like. And also, the position thereof is preferable to be properly selected by a relationship between rectification to be required and effect of reinforcement. Moreover, it is preferable to dispose the seal section for rectification/reinforcement 19 so that the upper end portion thereof is located approximately on an extended line of an inner edge direction of the outer peripheral sealed portion 1*u* at the lower side of the film-shaped non-return nozzle arriving at the pouring port thereof in order to enhance the rectification effect and open the pouring port 1*a* of the nozzle largely.

In such a flexible package bag, it is preferable to make sure the adhesion between the two front and rear plastic laminate films constituting the film-shaped non-return nozzle in order to effectively develop the non-return function of the film-shaped non-return nozzle. To this end, it is effective to apply the wetting treatment to the inner surface of the pouring path of the plastic laminate film constituting the non-return nozzle.

The wetting treatment is a treatment for making sure the adhesion acting between the mutual plastic laminate films and effectively developing the above-mentioned outer non-return function (preventing penetration of ambient air into the bag). The surface of the sealant film made from PE, PP, EVA, ionomer or the like in the plastic laminate film is subjected to the wetting treatment such as corona discharge treatment, UV ozone treatment, resin coating treatment, metal deposition treatment, non-electrolytic plating treatment, metal low-temperature spraying treatment, plasma etching treatment, flaming treatment or the like as a preferable example, whereby the wettability of the film is improved through a synergic effect of physical surface modification on the film surface and chemical surface modification based on the formation of polar functional groups.

Figure 4:
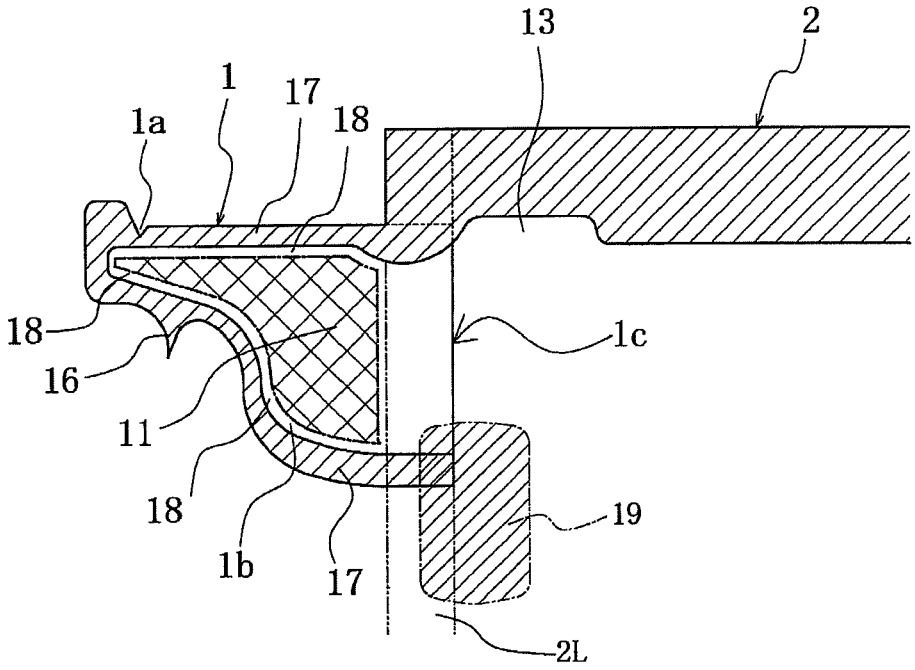
FIG. 4 is a partial enlarged view showing a wet treating area in the conventional film-shaped non-return nozzle.

In addition, the wet-treated layer is previously formed in the plastic laminate film before the formation of the film-shaped non-return nozzle in response to the shape of the pouring path of the nozzle. However, if it is intended to form the non-return nozzle by superimposing the two front and rear plastic laminate films subjected to the wetting treatment, a wet-treated portion and a pouring path portion cannot be overlaid correctly. For example, as shown by an enlarged view of the film-shaped non-return nozzle in FIG. 4, there is a fear that a portion 18 not subjected to the wetting-treatment (non-wet-treated portion) is caused in the boundary between the pouring path 8 and the outer peripheral sealed part 17 of the nozzle (side edge of the pouring path). Especially, when the liquid packed material is a material with a low wettability such as water or the like, the effect of adhesion-sealing of the plastic laminate films to each other in association with the intermolecular force of the liquid packed material cannot be achieved, and there is a fear that when the tip of the nozzle 1 is opened by tearing, air or the like penetrates from the pouring port 1*a* through the non-wet-treated portion 18 of the pouring path 8 resulting in pollution of the liquid packed material in the package bag.

Moreover, a portion of the boundary between the pouring path 8 and the outer peripheral sealed part 17 of the nozzle (side edge of the pouring path) is originally a portion being weak in the adhesion based on the intermolecular force of the plastic laminate films, so that it was required to strengthen this portion.

Figure 5:
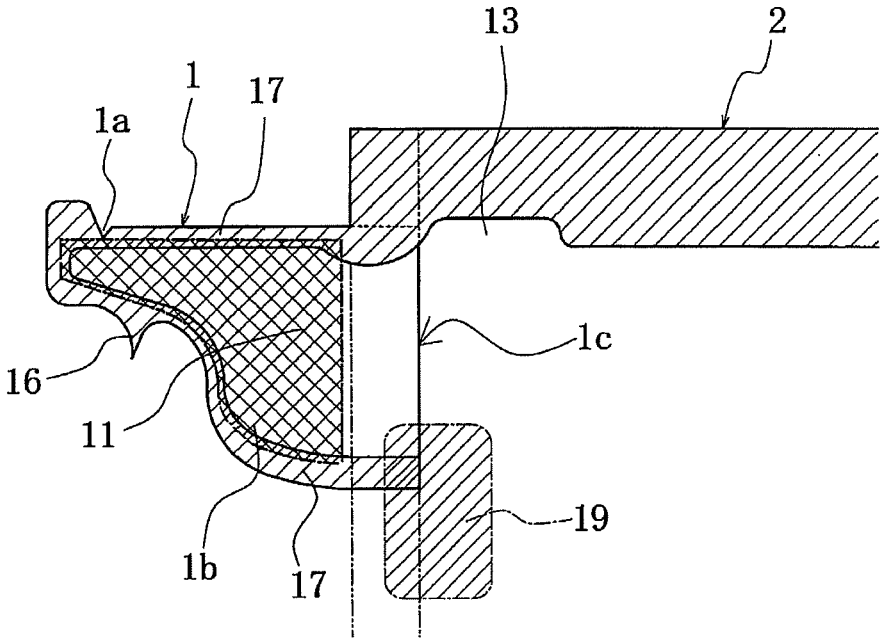
FIG. 5 is a partial enlarged view showing a wet treating area in the film-shaped non-return nozzle according to the present invention.

In order to remove such a disadvantage, according to the present invention, it is preferable to apply the wetting treatment to the whole inner surface of the pouring path. As one embodiment of the film-shaped non-return nozzle is shown in FIG. 5, it is desirable to apply the wetting treatment 11 to a portion corresponding to the pouring path 8 of the plastic laminate film and a portion ranging outward to 1 to 3 mm from the side edge of the pouring path 8 in the outer peripheral sealed part 17 (range shown by shading).

Thus, according to the present invention, the wetting treatment 11 is surely applied to the whole of the pouring path 8, so that there is no fear that the non-wet-treated portion is caused between the pouring path 8 and the outer peripheral sealed part 17 of the non-return nozzle as in the conventional case, and penetration of air or the like into the package bag can be completely prevented irrespective of the wettability or the like of the liquid packed material.

Also, fusion is apt to be peeled off in the boundary portion between the pouring path 8 and the outer peripheral sealed part 17 of the nozzle subjected to the wetting treatment 11 by the pressure generated in the pouring of the liquid packed material. In the present invention, however, the wetting treatment 11 is applied to a portion of the outer peripheral sealed part 17 of the nozzle ranging outward from the side edge of the pouring path 8 to 1-3 mm, so that the self-sealing non-return function can be developed effectively even if the boundary portion between the outer peripheral sealed part 17 of the nozzle and the pouring path 8 is peeled off.

Moreover, the reason why the range of the wetting treatment 11 is limited to not only the pouring path 8 but also the portion ranging outward from the side edge of the pouring path 8 to 1-3 mm is due to the fact that when the outer portion is less than 1 mm, there is a fear that a portion not subjected to the wetting treatment is exposed if the fusion in the boundary portion between the pouring path 8 and the outer peripheral sealed part 17 of the nozzle is peeled off. On the other hand, when the wetting treatment is applied to a portion exceeding 3 mm from the side edge of the pouring path 8, there is a fear that the outer peripheral sealed part 17 of the nozzle is peeled off because the thickness of the outer peripheral sealed part 17 of the nozzle is usually about 0.5-3 mm.

In the film-shaped non-return nozzle according to the present invention, the length of the opening tip portion of the nozzle or the length of the edge portion of the pouring port thereof is preferable to be about 5-100 mm irrespective of the lamination number in the plastic laminate film. When the length of the opening portion of the non-return nozzle is less than 5 mm, the pouring amount is too little in relation with the volume of the main bag body part, while when it exceeds 100 mm, it is difficult to exactly identify the pouring direction.

In the present invention, it is preferable to form a tear-inducing flaw of opening means such as I-notch, V-notch, U-notch, base notch, diamond cut or the like at a predetermined opening position (pouring port) 1*a* of the film-shaped non-return nozzle 1 as shown in FIG. 2. By opening the tear-inducing flaw is made use situation.

In the embodiment of the film-shaped non-return nozzle 1 shown in FIG. 2, a steeple-like protrusion 16 for prevention of liquid dripping is disposed at a position somewhat biased from the predetermined opening position 1*a* of the lower edge part of the nozzle toward the base end portion 1*c* thereof. Even if liquid dripping is caused from the pouring port 1*a* of the film-shaped non-return nozzle 1, the liquid dripping runs down along the protrusion 16 before arriving at a side portion located in the lower side of the package bag, so that there is no pollution in the main package bag body 2, an interior of an outer vessel surrounding it and the like, and a fear of running down liquid dripping to an unintended place can be removed effectively.

In the present invention, it is desirable to form a coating layer 10 of a water repellant substance/an oil repellant substance on at least an outer surface of the opening portion 1*a* (pouring port) of the film-shaped non-return nozzle 1 or an outer surface of the predetermined opening portion 1*a* and its vicinity and the protrusion 16 for prevention of liquid dripping. When such a treatment is applied to the film-shaped non-return nozzle 1, if the pouring of the liquid packed material is stopped by restoring the package bag to the standing posture, so-called liquid cutting property can be enhanced to effectively prevent unintentional dropping down of the liquid packed material.

As the water repellant substance is used a silicone oil or a water repellant coating agent made of a fluorine resin, an acrylic resin or an amide resin, and as the oil repellant substance is used an oil repellant coating agent made of a silicone resin, a Teflon resin, a silicon-modified acrylic resin or the like. In addition to such a substance, a resin such as a urethane resin, an acrylic resin, an ester resin, a nitrocellulose based resin, an amide resin, a vinyl chloride based resin, a rubbery resin, a styrenic resin, an olefinic resin, a vinyl hydrochlorinate resin, a cellulose resin, a phenolic resin or the like can be added as a binder.

Figure 6:
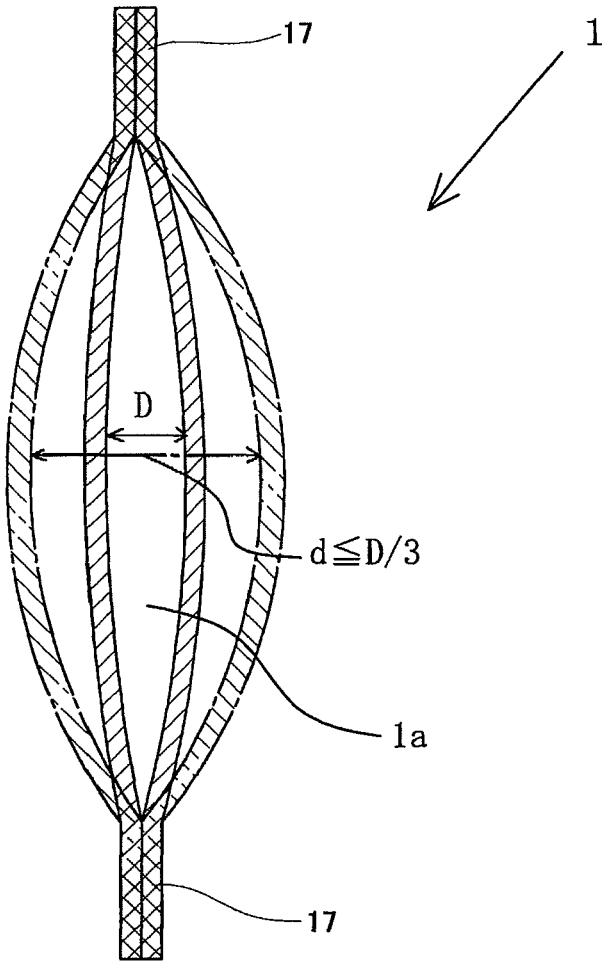
FIG. 6 is an enlarged sectional view of a pouring port in the film-shaped non-return nozzle according to the present invention.

In the film-shaped non-return nozzle of the present invention, as the opening diameter of the pouring port at the tip of the nozzle becomes narrower, the penetration of ambient air can be prevented effectively, but if it is too narrow, the liquid packed material is hardly poured. In the present invention, therefore, the opening diameter (d) of the pouring port 1*a* of the film-shaped non-return nozzle is preferable to be not more than ⅓ of the maximum opening diameter (D) ($d \leq \frac{1}{3}D$) as shown by a section view in FIG. 6. The opening diameter (d) of the pouring port 1*a* of the nozzle can be adjusted not only by the shape of the nozzle 1 and selection of a material of the plastic laminate film constituting the nozzle but also by selecting the position or the shape of the seal section for rectification/reinforcement 19 formed beneath the fused portion between the main package bag body 2 and the non-return nozzle 1 (nozzle base end portion 1*c*).

In such a flexible package bag of the present invention, it is preferable that the sealant layer at the outer surface side of the film-shaped non-return nozzle is made from a low-melting point material and the base end portion thereof is fusion-joined to the sealant layer at the inner surface side of the main package bag body at a posture of protruding from the side portion of the main bag body, mostly from the side portion of the upper end part thereof, whereas the sealant layer at the inner surface side of the film-shaped non-return nozzle is made from a high-melting point material and as shown, for example, in FIG. 2, when the film-shaped non-return nozzle 1 is fusion-joined to the inner surface of the main bag body 2, the inner surfaces in the based end portion 1*c* of the film-shaped non-return nozzle 1 are adhered to each other at a heat sealing strength lower than a half of an original heat sealing strength to form a temporally sealed portion 12 at a state of temporarily fusing at a relatively lower temperature.

Moreover, the temporary sealed portion 12 formed by the low-temperature temporary fusion can be realized by reducing at least one of a heating temperature, a pressurization force and a pressure time of heat-sealing means as compared with the case of forming perfect fusion-joined portion.

The position of forming the temporary fused portion is a position corresponding to a fusion-joining position of the film-shaped non-return nozzle 1 to the main package bag body 2 as illustrated in FIG. 2, but may be a position somewhat biased from the corresponding position toward the inside of the main package bag body 2 or inversely a position somewhat biased from the corresponding position toward the outside of the main package bag body 2. In any cases, it is necessary that the pouring path 8 of a sufficient length for developing the function inherent to the film-shaped non-return nozzle, namely the self-sealing non-return function (about 5-80 mm) is retained outside the temporary sealed portion 12 in the film-shaped non-return nozzle 1.

In the formation of the temporary fused portion, it is necessary to use a high-melting point sealant layer and a low-melting point sealant layer in the film-shaped non-return nozzle, but it is desirable to form both of these sealant layers with a low density polyethylene inclusive of a straight-chain low density polyethylene, or to form the high-melting point sealant layer with a middle density or high density polyethylene and form the low-melting point sealant layer with a low density polyethylene.

Moreover, the selection of high and low melting points in the same material of polyethylene can be realized, for example, by mutually changing extrusion laminating conditions and the like in the lamination of the sealant layers.

When the temporary sealed portion is formed in the base end portion of the film-shaped non-return nozzle at the fusion-joining position of the film-shaped non-return nozzle to the main package bag body or its vicinity as mentioned above, flowing of the liquid packing material filled in the package bag toward the tip side of the nozzle is prevented surely by the temporary sealed portion. Even if the liquid packed material is heated to 50-100° C., most part of the pouring path for the liquid packing material in the film-shaped non-return pouring nozzle is sufficiently protected from the permanent deformation of inflating the pouring path.

Thus, the tip end portion of the film-shaped non-return nozzle from the temporary sealed portion can always sufficiently develop the function of the film-shaped non-return nozzle, and penetration of ambient air into the main bag body can be prevented sufficiently in the pouring of the liquid packed material from the package bag, and also the self-seal non-return function can be surely achieved in the pouring stop of the liquid packed material.

In the package bag having the thus formed temporary sealed portion, when the liquid packed material in the bag after the cooling to about room temperature is poured from the package bag, the temporary sealed portion is opened by applying a load to the package bag in, for example, a thickness direction thereof, while the pouring port is opened by breaking or cutting the tip end portion of the film-shaped non-return nozzle. At such a state, the package bag is tilted to render the pouring port into a downward directing posture.

Moreover, the fusion-joined portion of the package bag other than the temporary sealed portion is heat-sealed at a strength higher by 2 times or more than that of the temporary sealed portion, so that accidental breakage is never caused even if a load required for opening the temporary sealed portion is applied to the bag.

Therefore, the film-shaped non-return nozzle portion not subjected to a distended deformation due to the heated liquid packed material can effectively prevent penetration of ambient air into the main package bag body associated with the pouring of the liquid packed material in the bag under necessary and sufficient opening of the pouring port in the crush deformation of the main package bag body. Also, when the pouring is stopped by restoring the package bag to the standing posture, penetration of ambient air into the main package bag body can be surely prevented by the self-sealing non-return function based on the restoring of the pouring nozzle portion wetted with the liquid packed material to the original form.

Even when each of the high-melting point sealant layer and the low-melting point sealant layer is made from a low density polyethylene, or when the high-melting point sealant layer is made from a middle density or high density polyethylene and the low-melting point sealant layer is made from a low density polyethylene, the temporary sealing with a sealing strength as is expected and the fusion joining required in the film-shaped non-return pouring nozzle can be realized simply and easily.

The heat sealing strength of the temporary sealed portion is preferable to be a range of 0.3-3 (N/15 mm), particularly 0.7-1 (N/15 mm). When the heat sealing strength is within this range, the accidental opening of the temporary sealed portion is prevented, while the temporary sealed portion can be opened non-randomly without having influences upon the other fusion-joined portion.

When the heat-sealing strength is less than 0.3 (N/15 mm), there is a fear of causing unintended opening of the temporary sealed portion in connection with the volume and the like of the liquid packing material in the bag at a heating state, while when it exceeds 3 (N/15 mm), there is a fear of accidentally affecting the load required for the opening of the temporary sealed portion to the other fusion-joined portion and so on (breakage or opening).

The load required for opening the temporary sealed portion is required to be a range of 50-350 (N), particularly 100-200 (N) in order not to accidentally cause the breakage or opening of the other fusion-joined portion inclusive of the sealed portion during transportation or work.

Namely, when the opening load is less than 50 (N), there is a fear of opening a temporary sealed portion of a package bag located at lower position in the stacking of package bags each filled with the liquid packed material, while when it exceeds 350 (N) or when the heat sealing strength is too high, there is a fear that the other fusion-joined portion is affected by the load required for opening the temporary sealed portion.

In the flexible package bag of the present invention, the main package bag body can be self-stood by forming a self-standing bottom in the lower end of the main package bag body. In this case, the main package bag body is preferably a bag sealed at three sides except the self-standing bottom. Because, by subjecting left and right side edges of the main bag body to longitudinal sealing can be maintained a flat and planular form at the upper part of the standing posture even after the liquid packed material is filled in the main package bag body at a gas-less state by in-liquid seal-packing or the like, or the flattening property (flatness) of the two front and rear plastic laminate films constituting the film-shaped non-return nozzle can be made higher, which guarantees the non-return function of the film-shaped non-return nozzle and acts effectively to surely maintain the non-return function after the pouring of the liquid packed material.

Figure 7:
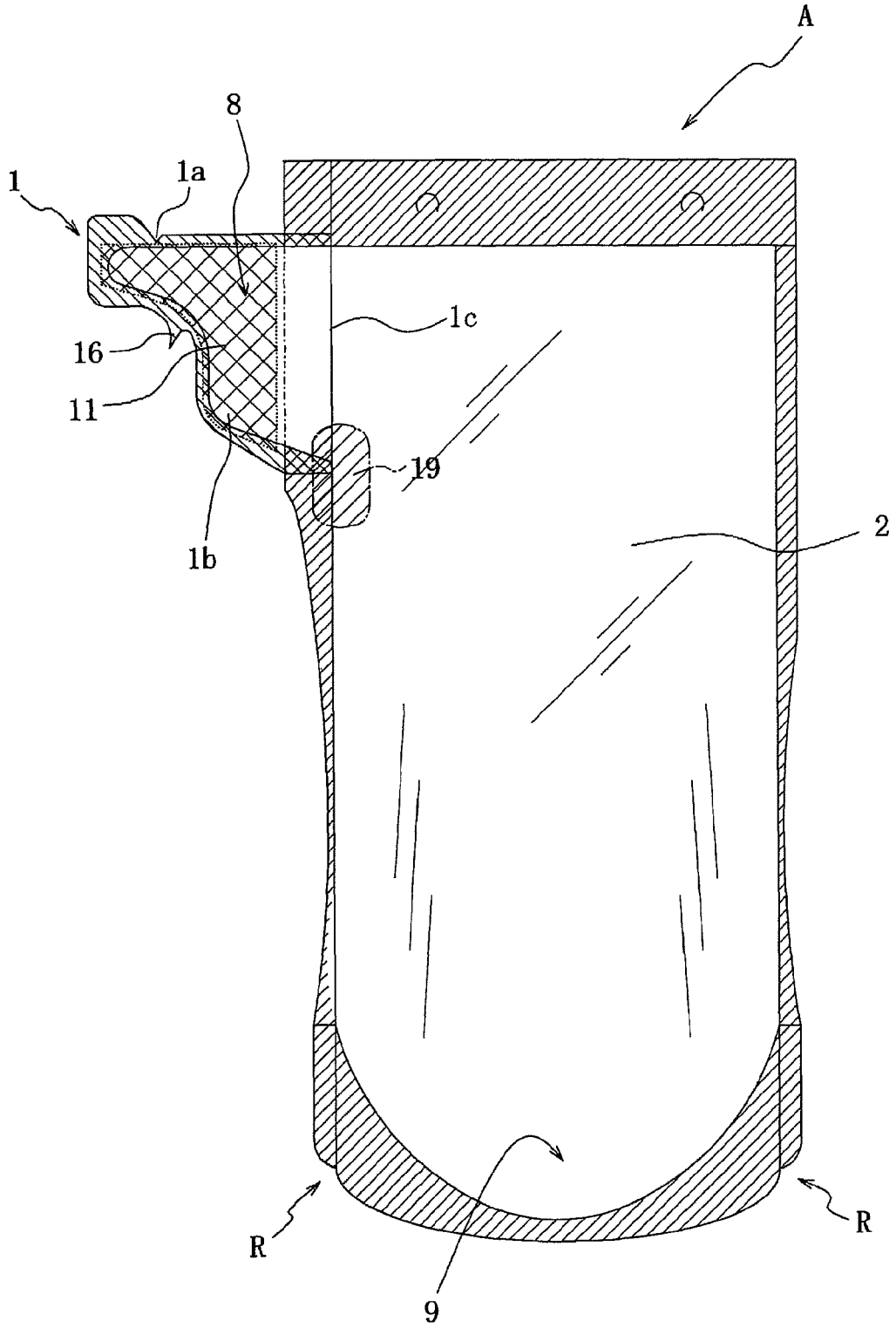
FIG. 7 is a front view showing another embodiment of the the flexible package bag according to the present invention.

As shown in an embodiment of FIG. 7, the flexible package bag A having the self-standing bottom according to the present invention is a self-standing type standing pouch having a ship's bottom portion 9 in a lower end portion (bottom portion) of the main package bag body 2, and is preferable to be a self-standing bag wherein three sides except the bottom portion 9 are fusion-joined by heat sealing or the like. Thereby, the standing posture can be kept such that the upper part is in a flat and planular shape and the lower part is in a cylindrical shape by the longitudinal sealing subjected to the right and left side edges even after the gas-less filling of the liquid packed material into the main package bag body 2. Therefore, the two front and rear soft plastic laminate films 3, 4 constituting the film-shaped non-return nozzle 1 are high in the flattening property (flatness), and can develop the self-sealing non-return function effectively.

As shown in FIG. 7, the ship's bottom part 9 is preferable to be shaped into a downwardly convex and gentle curved form by chamfering both corner parts of the bottom portion 9. In this case, the both corner parts of the bottom portion 9 are not contacted with a floor face in the grounding, and hence the full lower end of the self-standing type standing pouch S is contacted with the floor face, whereby the self-standing posture can be ensured stably.

Moreover, the both corner parts of the ship's bottom portion 9 in the self-standing type standing pouch are preferable to be chamfered so as to have a radius of curvature R of not less than 8 mm, more preferably 8 mm to 20 mm. Particularly, the radius of curvature R is preferable to be shaped so as to gradually reduce toward the bottom of the standing pouch S. Moreover, the reason why the radius of curvature R is limited to not less than 8 mm is due to the fact that when it is less than 8 mm, the both corner parts of the ship's bottom portion are contacted with the floor face to float up the central portion of the standing pouch.

INDUSTRIAL APPLICABILITY

The technique of the present invention is utilizable as a commonly-used package bag for packing a liquid material, especially as a refill package bag provided with a liquid pouring port.

DESCRIPTION OF REFERENCE SYMBOLS

A flexible package bag
S standing pouch
1 film-shaped non-return nozzle
1*a* predetermined opening position (pouring port)
1*b* liquid reserving portion
1*c* base end portion
1*u* outer peripheral sealed portion at lower side
2 main package bag body
2L longitudinal sealed portion side nozzle
3, 4 plastic laminate film
5, 5' base film layer
6, 6' inner sealant layer
7, 7' outer sealant layer
8 pouring path
9 bottom portion
10 water-repellant/oil-repellant coating layer
11 wet-treated layer
12 temporary sealed portion
16 protrusion for prevention of liquid dripping
17 outer peripheral sealed part of nozzle
18 non-wet-treated portion
19 seal section for rectification/reinforcement

The invention claimed is:

1. A flexible package bag, comprising:

a main package body composed of plastic laminate films;

a film-shaped non-return nozzle configured to prevent penetration of ambient air into the bag, the non-return nozzle having a base end portion fused to a first side of the package body to allow liquid flow from the package body through the non-return nozzle; and a seal section defined between two opposing plastic laminate films of the package body and disposed at a position of the package body including a lower end portion of a fused section of the base end portion, wherein the non-return nozzle comprises:

a tip portion configured to be removable to provide an opening for liquid to exit;

a pouring channel connected to the tip portion to allow liquid to be poured therethrough; and a liquid reserving portion disposed along the lower end portion of the base end portion for temporarily holding liquid next to the pouring channel to decrease a rate of liquid flow when liquid is being poured, and wherein the seal section extends in a first direction towards an upper end portion of the base end portion such that a first end portion of the seal section, which creates a dam with respect to the lower end portion of the non-return nozzle to temporarily hold liquid flown therein, is disposed above the lower end portion of the base end portion and on an extend line of a lower edge of the pouring channel.

2. The flexible package bag according to claim 1, wherein the seal section includes a heat seal section that has an ellipsoid form extending along the first side of the package body, the heat seal section including a fused section between a longitudinal seal section of the package body and the base end portion of the non-return nozzle.

3. The flexible package bag according to claim 1, wherein the base end portion of the non-return nozzle is fused at a low temperature by an opposed sealant layer made of a high-melting plastic film to define a temporary seal that temporarily seals inner surfaces of a pouring path of the non-return nozzle.

4. The flexible package bag according to claim 1, wherein the non-return nozzle has a wet-treated layer provided on an inner surface of at least one of two plastic laminate films constituting the non-return nozzle.

5. The flexible package bag according to claim 4, wherein the wet-treated layer is provided on a portion of the non-return nozzle constituting a pouring path and extends in a range of 1-3 mm outward from a side edge of the pouring path.

6. The flexible package bag according to claim 1, wherein when a tip portion of the non-return nozzle is torn, a pouring port is defined, the pouring port having an opening diameter in a thickness direction (d) being not more than 1/3 of a maximum opening diameter (D) ($d < 1/3D$).

7. The flexible package bag according to claim 1, wherein the seal section extends in a second direction opposite of the first direction such that a second end portion of the seal section is disposed below the lower end portion of the base end portion.

8. The flexible package bag according to claim 1, wherein the seal section is separately disposed from outer peripheral portions of the nozzle and the main package body.

* * * * *